United States Patent [19]

McDonald et al.

[11] 4,248,494

[45] Feb. 3, 1981

[54] AUTOMOBILE DASHBOARD POWER ADAPTER

[76] Inventors: Edward S. McDonald, 1508 Twenty-Fifth St., Woodward, Okla. 73801; G. M. Close, 400 Thorton Dr., Norman, Okla. 73069

[21] Appl. No.: 7,893

[22] Filed: Jan. 31, 1979

[51] Int. Cl.[3] ..... H01R 33/90

[52] U.S. Cl. ..... 339/154 A; 339/159 R; 339/159 C

[58] Field of Search ..... 339/154 R, 154 A, 158, 339/159 R, 159 C, 160, 161, 162, 169, 255 R, 182 R, 171

[56] References Cited

U.S. PATENT DOCUMENTS

| | | | |
|---|---|---|---|
| 1,078,586 | 11/1913 | Knauff | 339/171 |
| 1,103,244 | 7/1914 | Anderson | 339/182 R |
| 1,300,270 | 4/1919 | Ile | 339/161 |
| 1,332,867 | 3/1920 | Frankel | 339/159 |
| 1,379,244 | 5/1921 | Benjamin et al. | 339/161 |
| 1,803,096 | 4/1931 | Clemence | 339/158 |
| 3,099,505 | 7/1963 | Schwartz | 339/182 R |
| 4,054,352 | 10/1977 | Rudin | 339/154 R |
| 4,109,988 | 8/1978 | Olson | 339/154 A |

*Primary Examiner*—Neil Abrams
*Attorney, Agent, or Firm*—Robert M. Hessin

[57] ABSTRACT

A power adapter apparatus for use in providing plural system electrical power outputs from a vehicle dashboard cigarette lighter receptacle, comprising unitary frame means providing a cylindrical connector portion extending into a receptacle portion, said cylindrical portion being of a length and diameter for contacting reception within said cigarette lighter receptacle. The apparatus further including two or more receptacle means disposed in said frame means receptacle portion in like orientation and parallel alignment; first conductor means connected between said cylindrical connector portion and each of said two or more receptacle means to provide system electrical power connection; and second conductor means connected between said cylindrical connector portion and each of said two or more receptacle means to provide system ground connection.

2 Claims, 7 Drawing Figures

AUTOMOBILE DASHBOARD POWER ADAPTER

BACKGROUND OF THE INVENTION

1. Field of the Invention

The invention relates generally to power outlet adapter devices and, more particularly, but not by way of limitation, it relates to an improved adapter apparatus for use in providing parallel electrical outputs from an automobile cigarette lighter receptacle.

2. Description of the Prior Art

The prior art includes very few types of plural output electrical power adapters for use in dashboard receptacle connection, but such devices now find particular necessity in the present day of citizen's band mobile radios and other low voltage power consumption devices which may be used in a vehicle. Of particular interest is U.S. Pat. No. 4,054,352 as issued on Oct. 18, 1977 in the name of Rudin which relates to "Electrical Power Takeoff Unit for Cigarette Lighter Socket of Vehicle". However, this cigarette lighter receptacle device is directed to a hardwired form of power output wherein low voltage units such as calculators, clocks, computers and other relatively permanent installation devices may be utilized within a vehicle. The invention is characterized by a permanent wire connection and specialized electrical adaptation circuitry for providing such output from the cigarette lighter receptacle source. Such power adapter structure does not have the capability of ready interchangeability of source use nor the capability of total adapter usage, i.e., the complete degree of manipulation and control over power application and device selection.

SUMMARY OF THE INVENTION

The present invention contemplates a power adapter device for use with an automobile dashboard cigarette lighter receptacle wherein the entire unit including parallel voltage source outputs is enabled for rapid and positive operational disposition. The adapter device consists of a first connector portion which is readily insertable for electrical communication within a conventional form of dashboard cigarette lighter receptacle, and the connector portion is supported by a suitable frame which also serves to house two or more additional power receptacles of conventional type, each of which will provide parallel electrical output of chassis and system power voltage outputs from the associated connector. Since it is particularly desirable to have uniformity of output receptacles from the adapter device, the basic construction technique adheres to duplicative parts formation procedures such that mating engagement of identical frame halves serves to provide support for the device connector and the designated number of receptacle outlets.

Therefore, it is an object of the present invention to provide an automobile dashboard power adapter device that enables ready usage of various accessory equipments within the vehicle.

It is also an object of the present invention to provide a mode of manufacturing a power adapter device that is most economical and facile of assembly thereby to achieve a reliable and compact unit.

It is also an object of the present invention to provide a power adapter device which enables take-off of system power from a cigarette lighter receptacle while still enabling the use of the original cigarette lighter assembly.

Finally, it is an object of the present invention to enable a vehicle dashboard power adapter assembly that is simple and sturdy of construction, but yet stable in its operative seating so that power interconnection should not be lost during normal operation, even including accidental bumping and abuse.

Other objects and advantages of the invention will be evident from the following detailed description when read in conjunction with the accompanying drawings which illustrate the invention.

DETAILED DESCRIPTION OF THE INVENTION

Figure 1:
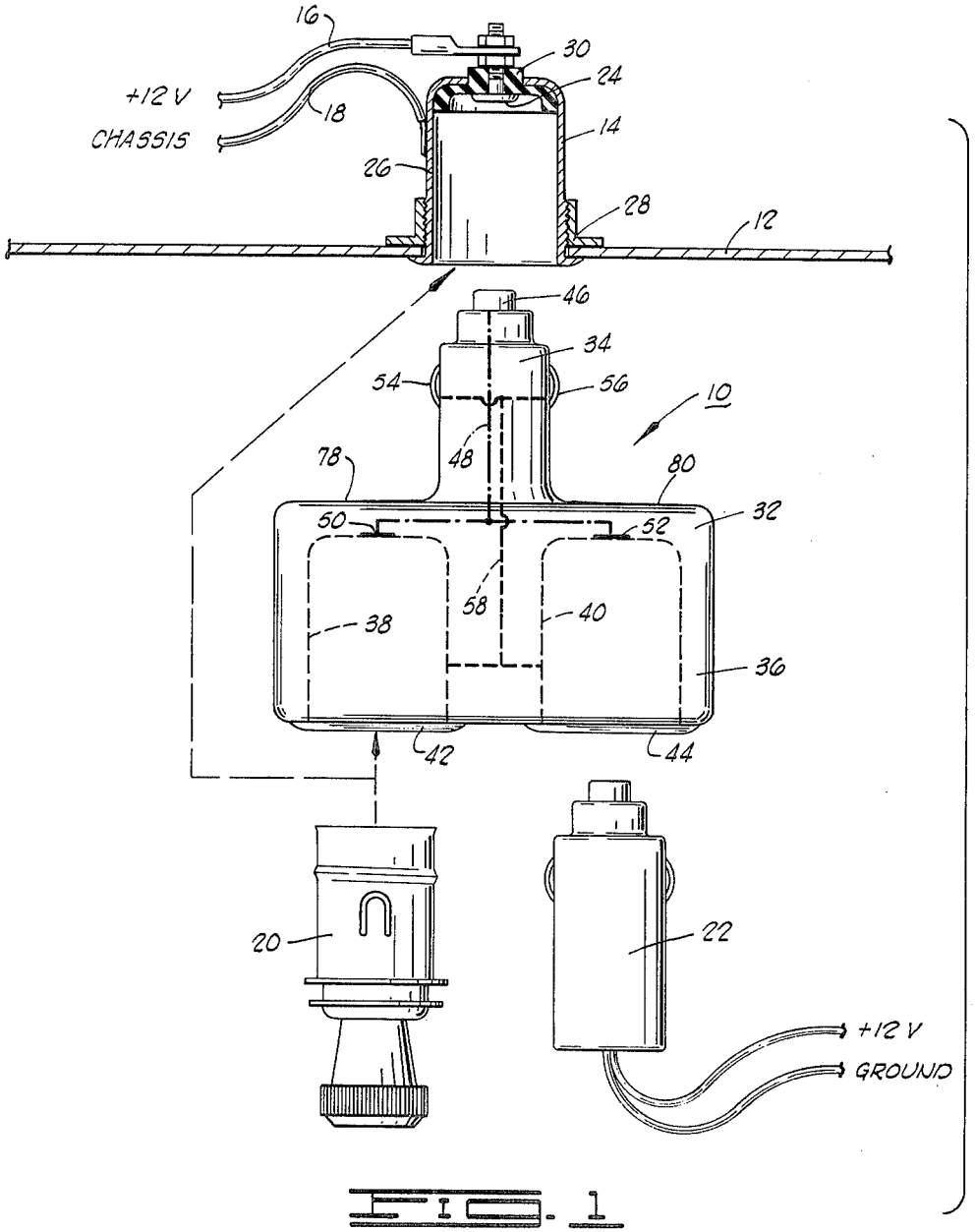
FIG. 1 is a top plan view of the invention in exploded form, with parts as shown in section, as it may be utilized in operation.

FIG. 1 illustrates in exploded form the manner in which power adapter 10 is utilized in an automotive vehicle dashboard 12 to provide a plurality of system power output connections. Thus, a conventional cigarette lighter receptacle lighter 14 supplied with system power via lead 16 and a ground or chassis connection 18 is disposed in well-known manner within dashboard 12, and it is cooperative with a standard form of cigarette lighter 20 in normal usage. However, the power adapter 10 may be interposed to provide a plurality of system power outlet receptacles for coaction with either the original cigarette lighter 20 or a standard form of power connector 22. The connector 22 is a well-known form and commercially available type of automotive D-C power connector as may be utilized with citizen's band radios, electric shavers, automotive radar detectors and the like.

While construction of receptacle 14 can vary somewhat, all such units are similar in that they include an axially central contact 24 that is connected to the positive or hot power lead 16 while the cylindrical wall 26 of receptacle 14 provides the ground connection as it may be chassis connected either by ground lead 18 or through securing collar 28 in the case of metal dashboards 12. A feed-through insulator 30 of ceramic material then provides electrical isolation as between positive voltage contact 24 and the grounded receptacle wall 26.

The power adapter 10 is generally supported by a frame 32 which provides formation of a connector 34 and the unitary and rigidly extending receptacle portion 36 which houses two or more power receptacles 38, 40, etc., each being accessible through respective outer collars 42, 44, etc. Positive power connection is provided through a spring-loaded metallic contact button 46 to provide positive voltage via dot-dash lines 48 to the positive contacts 50 and 52 of respective receptacles 38 and 40. In like manner, spring metal negative contacts 54 and 56 provide ground connection via dash line 58 to the cylindrical wall elements of receptacles 38 and 40.

Figure 2:
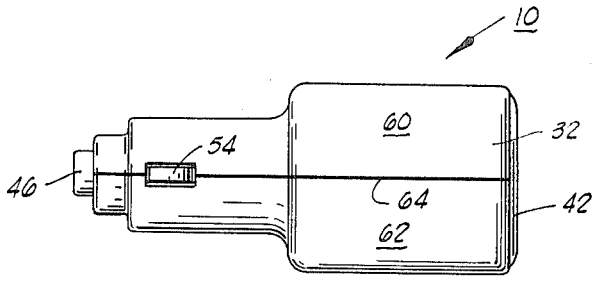
FIG. 2 is a side elevation of the dashboard adapter device.

FIGS. 2–7 illustrate a preferred form of construction for the power adapter 10. Thus, as shown in FIG. 2, the frame 32 is constructed of two identical, mating frame halves, an upper shell 60 and a lower shell 62, which may be bonded or snap-fastened together after insertion of the central components. The frame 32 would then extend the contact button 46 and ground contactors 54 and 56 into interactive position while also retaining the receptacles with respective collars 42 and 44 in operative position. The plane of joinder as along line 64 may be readily secured by any of well-known plastics techniques.

Figure 3:
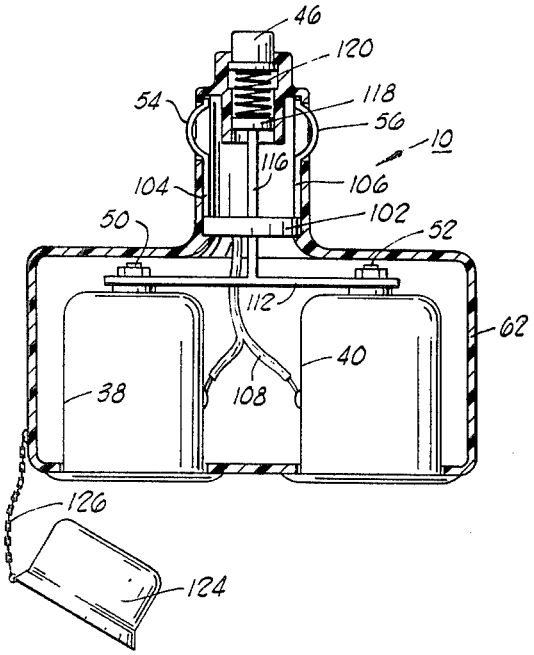
FIG. 3 is a top plan view of the adapter device with upper frame portion removed.
Figure 4:
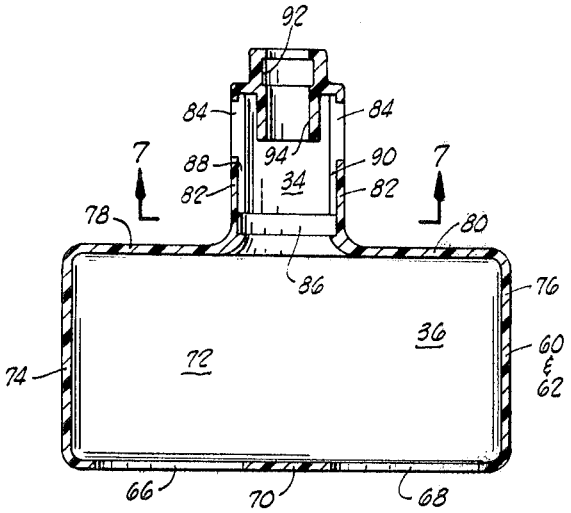
FIG. 4 is a top plan view of the lower frame portion of the present invention.
Figure 5:
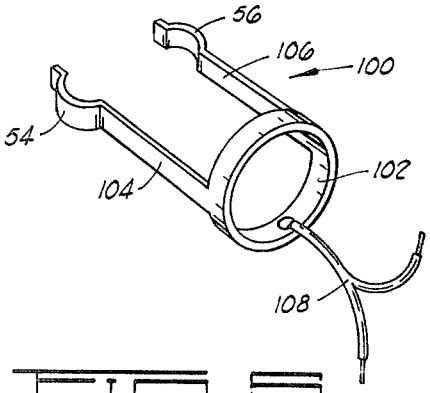
FIG. 5 is a perspective view of the ground contactor portion of the power adapter.
Figure 6:
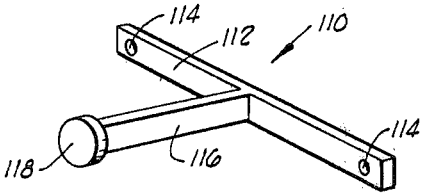
FIG. 6 is a perspective view of the system power contactor of the present invention.
Figure 7:
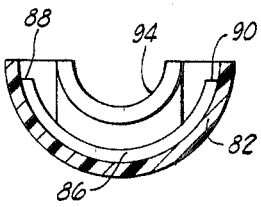
FIG. 7 is a section taken along lines 7—7 of FIG. 4.

FIG. 3 illustrates the interior of power adaptor 10 in top plan view as the components are disposed within lower shell 62. The shell formation is shown in FIG. 4 as each of the upper shells 70 and lower shell 62 may be identical. The shell is formed with the receptacle portion 36 and connector portion 34. Two or more semicircular cutouts 66, 68, etc., are formed across a front wall 70 of the shell receptacle portion 36, preferably in equi-spaced disposition. This shell portion is then further formed with an outer wall 72, side walls 74 and 76 and rear walls 78 and 80 which are molded to extend unitarily into receptacle portion 34 having cylindrical wall 82. Opposite sides of cylindrical wall 82 are formed with rectangular cutouts 84 which serve to provide a protrusion opening for ground contactors 54, 56, and locking channels are formed in relief as at semi-circular relief 86 and opposite side channels 88 and 90, these locking reliefs to provide interior component positioning upon assembly, as will be described. The outer end of connector portion 34 is then formed with further semi-circular bores, outer bore 92 and inner bore 94 which provide operative retention of contact button 46 and interior conductors, also to be further described. See also FIG. 7.

FIG. 3 then illustrates a bottom shell 62 as it may initially receive the inner operating components. The negative contactors 54 and 56 are unitarily formed as a contactor element 100, see FIG. 5, which consists of a ring 102 extending oppositely disposed tines 104 and 106 into formation of the contactors 54 and 56, respectively. Such as a wire connector 108 may then be utilized in conventional manner to provide connection between ring 102 and the two or more receptacles. Upon assembly, the ring 102 and opposite tines 104 and 106 seat within respective relief channels 86 and 88, 90 so that final assembly provides locking engagement therein in proper position. See also FIG. 7.

Positive voltage connection is made simply by a T-bar 110. T-bar 110 may be unitarily formed as a connector bar 112 having two or more contact holes 114 with a generally centrally connected conductor bar 116 extending into a circular contactor 118. Thus, in assembly, connector bar 112 may be secured to respective positive voltage contacts 50 and 52 of receptacles 38 and 40, as conductor bar 116 extends into inner bore 94 and into contact with a conductive compression spring 120 which also maintains electrical continuity with contact button 46. In assembly, a bottom shell 62 receives the negative contactor element 100 with seating of ring 102 within channel 86, and then the two or more receptacles with associated T-bar 112 are inverted along with spring 120 and contact button 46, as is indicated in FIG. 3. Then, finally, an upper shell 60 (identical to shell 62) is secured over the top in mating engagement with lower shell 62 and all interior components and contactors are retained in operative position.

The unit is then ready for operational usage and, as shown in FIG. 1, the adapter device 10 can be inserted into the conventional dashboard lighter receptacle 14 so that positive 12 volts is received through contact button 46 and chassis or ground contact is conductive through contractors 54 and 56, such electrical connection then being affixed in parallel with the respective two or more receptacles 38 and 40. Thus, the original cigarette lighter 20 can be placed in one receptacle 38 while one or more remaining receptacles are available to receive a standard connector 22 for supply of system power to an accessory equipment such as a citizen's band radio and the like. Insertion of the power adapter 10 allows the rear walls 78 and 80 of frame 32 to be brought into abutment with dashboard 12 so that further stability is enabled during usage of adapter 10. Such stability prevents faulty power connection due to accidental bumping or the like.

As shown in FIG. 3, it is also desirable to provide protective caps that may be placed within the respective receptacles 38, 40, etc. when such units are not in use. Thus, a molded plastic cup 124 as may be supported by a light chain 126 attached to the side wall of the frame 32 may be utilized. Of course, although not shown there would be a protective cup 124 attached in association with each of the plurality of receptacles.

The foregoing discloses a novel form of electrical power adaptor that is relatively simple of construction yet extremely reliable in operation and resistant to damage. The device utilizes an extremely simplified method of fabrication wherein individual conductor elements are unitarily formed for subsequent insertion and locking retention in operative relationship within two identical plastic shells which then serve to provide the outer frame. Such outer shells may of course be formed with any of various decorative or aesthetic markings or shapes thereby to further enhance appearance of the finished article. It should also be understood that while two receptacles only are shown for the power adapter, it is merely a matter of choice to provide any number of receptacle outlets in the assembly.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. Power adapter apparatus for use in combination with a conventional cigarette lighter automobile dashboard adapter, comprising:

first connector means, including opposite electrical polarity conductors, for insertion and electrical communication within said dashboard receptacle;

first receptacle means connected in electrical communication with said first connector means;

second receptacle means connected in electrical communication with said first receptacle means; and frame means rigidly supporting said first connector means, said first receptacle means and said second receptacle means in operative relationship when said power adapter apparatus is positioned in said automobile dashboard, said frame means consisting of first and second mating shells each formed as a unitary connector portion and receptacle portion, and including a locking relief formation circumferentially within said connector portion;

a unitary first polarity conductor formed as a T-bar conductor bar that is connectible to each of said first connector means and first and second receptacle means; and a unitary second polarity conductor formed with a supporting ring to be received in said locking relief formation while extending oppositely disposed, parallel extending spring contactors to provide connection between said first connector means and first and second receptacle means.

2. Apparatus as set forth in claim 1, wherein said frame means further comprises:

an axially extending central bore formed in said connector portion thereby to receive said T-bar conductor bar in positive retention.

* * * * *